US010213057B2

(12) United States Patent
Geels et al.

(10) Patent No.: US 10,213,057 B2
(45) Date of Patent: Feb. 26, 2019

(54) BATHING VESSEL HAVING WALL REINFORCEMENT PANEL

(75) Inventors: Michael Glenn Geels, Jackson, TN (US); Jeffrey McKinley Boyd, Savannah, TN (US); Scott Kapelanski, Howell, MI (US)

(73) Assignee: DELTA FAUCET COMPANY, Indianapolis, IN (US)

( * ) Notice: Subject to any disclaimer, the term of this patent is extended or adjusted under 35 U.S.C. 154(b) by 1181 days.

(21) Appl. No.: 13/883,767

(22) PCT Filed: Sep. 2, 2011

(86) PCT No.: PCT/US2011/050345

§ 371 (c)(1),
(2), (4) Date: May 7, 2013

(87) PCT Pub. No.: WO2012/067694

PCT Pub. Date: May 24, 2012

(65) Prior Publication Data

US 2013/0219611 A1 Aug. 29, 2013

Related U.S. Application Data

(60) Provisional application No. 61/413,575, filed on Nov. 15, 2010.

(51) Int. Cl.
*A47K 3/04* (2006.01)
*A47K 3/02* (2006.01)
(Continued)

(52) U.S. Cl.
CPC ..... *A47K 3/04* (2013.01); *A47K 3/02* (2013.01); *A47K 3/16* (2013.01); *A47K 3/30* (2013.01);
(Continued)

(58) Field of Classification Search
CPC ..... A47K 3/02
(Continued)

(56) References Cited

U.S. PATENT DOCUMENTS

2004/0229010 A1 11/2004 Clark et al.
2005/0092889 A1 5/2005 Pence
(Continued)

FOREIGN PATENT DOCUMENTS

JP 2005007870 A * 1/2005

OTHER PUBLICATIONS

English Abstract of Ogura dated Nov. 18, 2015.*
(Continued)

*Primary Examiner* — Christine Skubinna
(74) *Attorney, Agent, or Firm* — Carlson, Gaskey & Olds, P.C.

(57) ABSTRACT

A bathing vessel includes a base and at least one wall extending vertically from the base. The wall includes a multi-layer structure that includes a layer of acrylic material on a first layer of polyurethane material, a layer of acrylonitrile butadiene styrene (ABS) material between the layer of acrylic material and the first layer of polyurethane material, and a second layer of polyurethane material between the layer of ABS material and the first layer of polyurethane material. A wood-containing composite panel is chemically bonded to at least one of the first or second layers of polyurethane material.

9 Claims, 3 Drawing Sheets

(51) Int. Cl.
*A47K 3/30* (2006.01)
*B05D 3/12* (2006.01)
*A47K 3/16* (2006.01)

(52) U.S. Cl.
CPC ..... *B05D 3/12* (2013.01); *Y10T 29/49* (2015.01); *Y10T 29/49826* (2015.01)

(58) Field of Classification Search
USPC ..... 4/584; 428/215
See application file for complete search history.

(56) References Cited

U.S. PATENT DOCUMENTS

| | | | |
|---|---|---|---|
| 2005/0276941 | A1 | 12/2005 | Kapelanski et al. |
| 2005/0281997 | A1 | 12/2005 | Grah |
| 2006/0099405 | A1 | 5/2006 | Guiselin et al. |

OTHER PUBLICATIONS

English machine translation dated Nov. 18, 2015.*
International Preliminary Report on Patentability for International Application No. PCT/US2011/050345 completed on May 21, 2013.
International Search Report for PCT Application No. PCT/US2011/050345 completed on Dec. 5, 2011.

* cited by examiner

BATHING VESSEL HAVING WALL REINFORCEMENT PANEL

RELATED APPLICATION

This application is a United States National Phase of PCT Application No. PCT/US11/050345 filed on Sep. 2, 2011, which claims priority to U.S. Provisional Application No. 61/413,575 filed on Nov. 15, 2010.

BACKGROUND

This disclosure relates to composite bathing vessels.

Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the relevant requirements may be approved for use in homes, buildings or other structures as a plumbing fixture.

SUMMARY

An exemplary bathing vessel includes a base and at least one wall extending vertically from the base. The wall includes a multi-layer structure wherein at least one of the layers is a polyurethane material. A wood-containing composite panel is chemically bonded to the layer of polyurethane material.

In one aspect, the multi-layer structure of the bathing vessel may include a layer of acrylic material arranged on a first layer of polyurethane material, a layer of acrylonitrile butadiene styrene material between the layer of acrylic material and the first layer of polyurethane material, and a second layer of polyurethane material between the layer of acrylonitrile butadiene styrene material and the first layer of polyurethane material.

An example method for forming a bathing vessel includes chemically bonding a wood-containing composite panel to a polyurethane material which is a layer of a multi-layer structure of a wall that extends vertically from a base of the bathing vessel.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
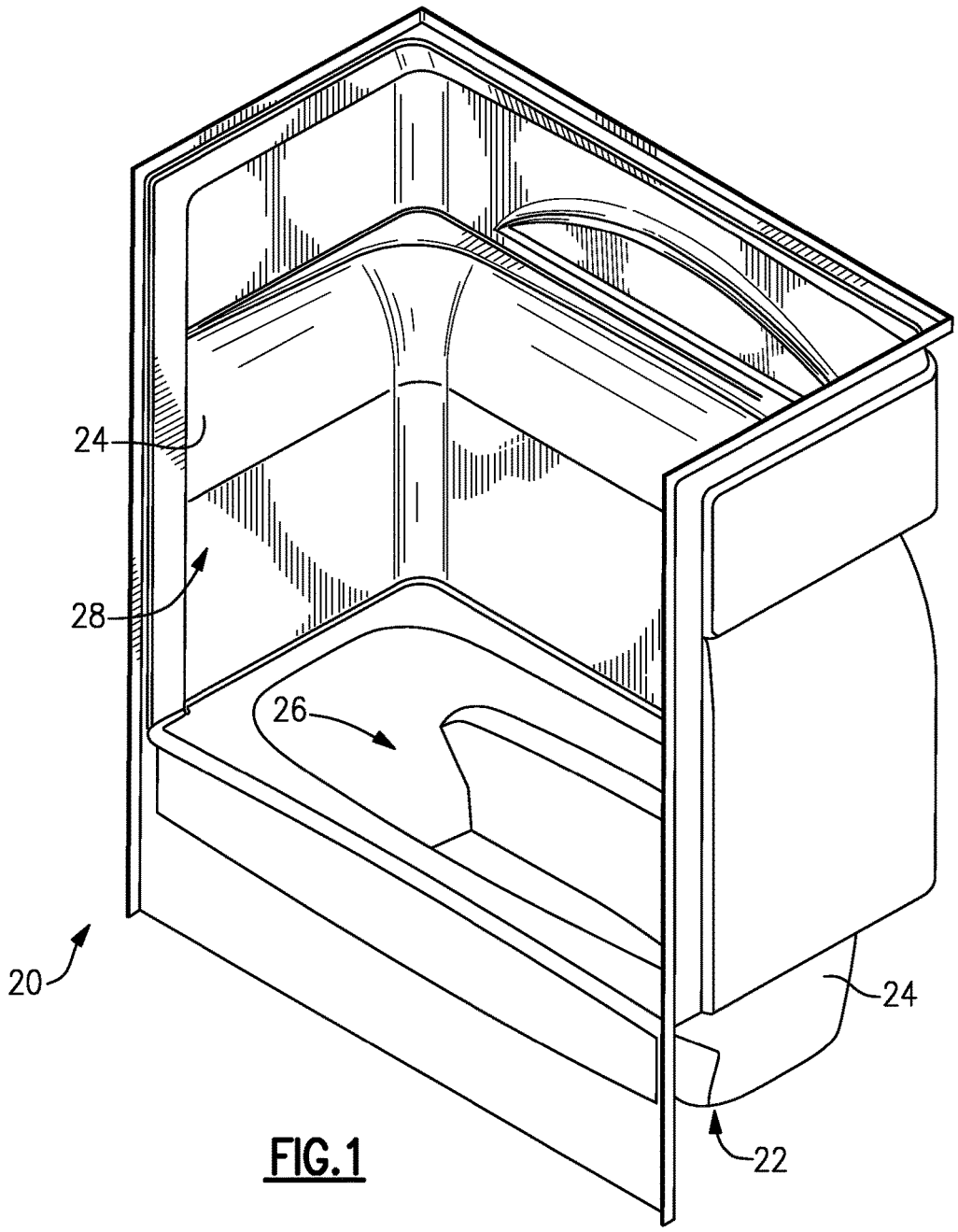
FIG. 1 shows an example bathing vessel.

FIG. 1 illustrates selected portions of an example bathing vessel 20. In general, the bathing vessel 20 includes a base 22 that serves as the bottom of the bathing vessel 20 and supports one or more walls 24. The walls 24 extend vertically from the base 22 to form a tub portion 26 and a shower surround potion 28. However, in alternative embodiments, the walls 24 may form only a tub portion 26 or only a shower surround portion 28 from the base 22. Thus, it is to be understood that the examples disclosed herein are not limited to the illustrated design.

Figure 2:
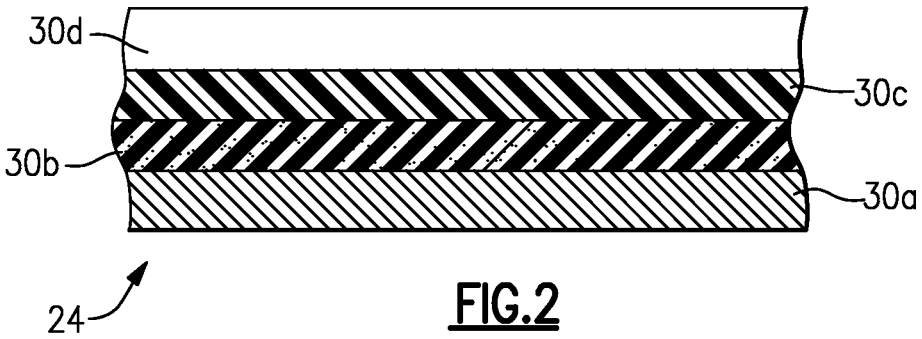
FIG. 2 shows a cross-section of a multi-layer structure of a wall of a bathing vessel.

FIG. 2 shows a cross-section through a portion of one of the walls 24. The walls 24 have a multi-layer structure that generally includes a first layer of polyurethane material 30*a*, a second layer of polyurethane material 30*b*, a layer of acrylonitrile butadiene styrene (ABS) material 30*c*, and a layer of acrylic material 30*d* (collectively layers 30*a-d*), such as polymethylmethacrylate. As shown, the layer of acrylic material 30*d* is a top layer and is exposed for view to a user within the bathing vessel 20. The layers 30*b* and 30*c* are intermediate layers, and the layer 30*a* is a bottom-most layer (cap layer) that is generally obscured from view of a user within the bathing vessel 20. Each of the layers 30*a-d* is bonded to its respective neighboring layer or layers. In embodiments, the specific materials and order of the layers 30*a-d* contribute to providing the bathing vessel with a desired degree of strength, such as to meet relevant standards of the American National Standards Institute (ANSI).

In embodiments, the layer of acrylic material 30*d* is arranged on the first layer of polyurethane material 30*a*, the layer of acrylonitrile butadiene styrene (ABS) material 30*c* is arranged between the layer of acrylic material 30*d* and the first layer of polyurethane material 30*a*, and the second layer of polyurethane material 30*b* is arranged between the layer of ABS material 30*c* and the first layer of polyurethane material 30*a*. In some examples, additional layers may be arranged among the layers 30*a-d*. In other examples, the walls 24 include only the layers 30*a-d* and are free of other layers, materials, adhesives, or the like.

The thicknesses of the individual layers 30*a-d* is not necessarily shown to scale and may vary, depending on the desired wall strength and location in the wall 24, for example. In embodiments, the ratio of the thickness of the layer of acrylic material 30*d* to the thickness of the layer of ABS material 30*c* is no greater than 1, to facilitate meeting strength and deflection requirements, and the combined thickness of the layer of acrylic material 30*d* and the layer of ABS material 30*c* may be between 0.01 inches and 0.3 inches.

In embodiments, the first layer of polyurethane material 30*a*, the second layer of polyurethane material 30*b* or both, are foamed polyurethane materials. In some examples, the density of the first layer of polyurethane material 30*a* is different than the density of the second layer of polyurethane material 30*b*. For instance, the density of the first layer of polyurethane material 30*a* is greater than the density of the second layer of polyurethane material 30*b*, to facilitate meeting strength and deflection requirements. A ratio between the density of the rigid polyurethane foam layer 30*b* and the thickness of the rigid polyurethane foam layer 30*b* is between 80-1:1.

In a further example, the second layer of polyurethane material 30*b* is a rigid layer and has a density of 1-10 pounds per cubic foot. The first layer of polyurethane material 30*a* is an elastomeric layer and has a density of about 25-65 pounds per cubic foot, though in some examples the density is approximately 55-65 pounds per cubic foot. In one example, the density is approximately 62 pounds per cubic foot.

The bathing vessel 20 may also include a fixture 40 (FIG. 8) affixed to one of the walls 24. As an example, the fixture 40 may be an assist bar, seat, or other similar type of fixture that is intended to bear a load. In that regard, the portion of the wall 24 that the fixture 40 is affixed to includes a wood-containing composite panel 42 that is chemically bonded to the first layer of polyurethane material 30*a*, the second layer of polyurethane material 30*b* or both. The wood-containing composite panel 42 reinforces the wall 24 and helps to reduce wall deflection in the area of the fixture 40, such as to meet desired strength and deflection requirements.

The wood-containing composite panel 42, such as oriented strand board, may be a composite of wood particles held together with a polymeric resin material, such as but not limited to phenol formaldehyde or methyl diphenyl diisocyanate. The resin material of the wood-containing composite panel chemically bonds with the polyurethane material and thereby forms the strong composite structure. As an example, a chemical bond may refer to an attraction between atoms or molecules, such as covalent bonding, dipole-dipole interactions, London dispersion forces and hydrogen bonding.

Figures 3, 4, 5, 6, 7:
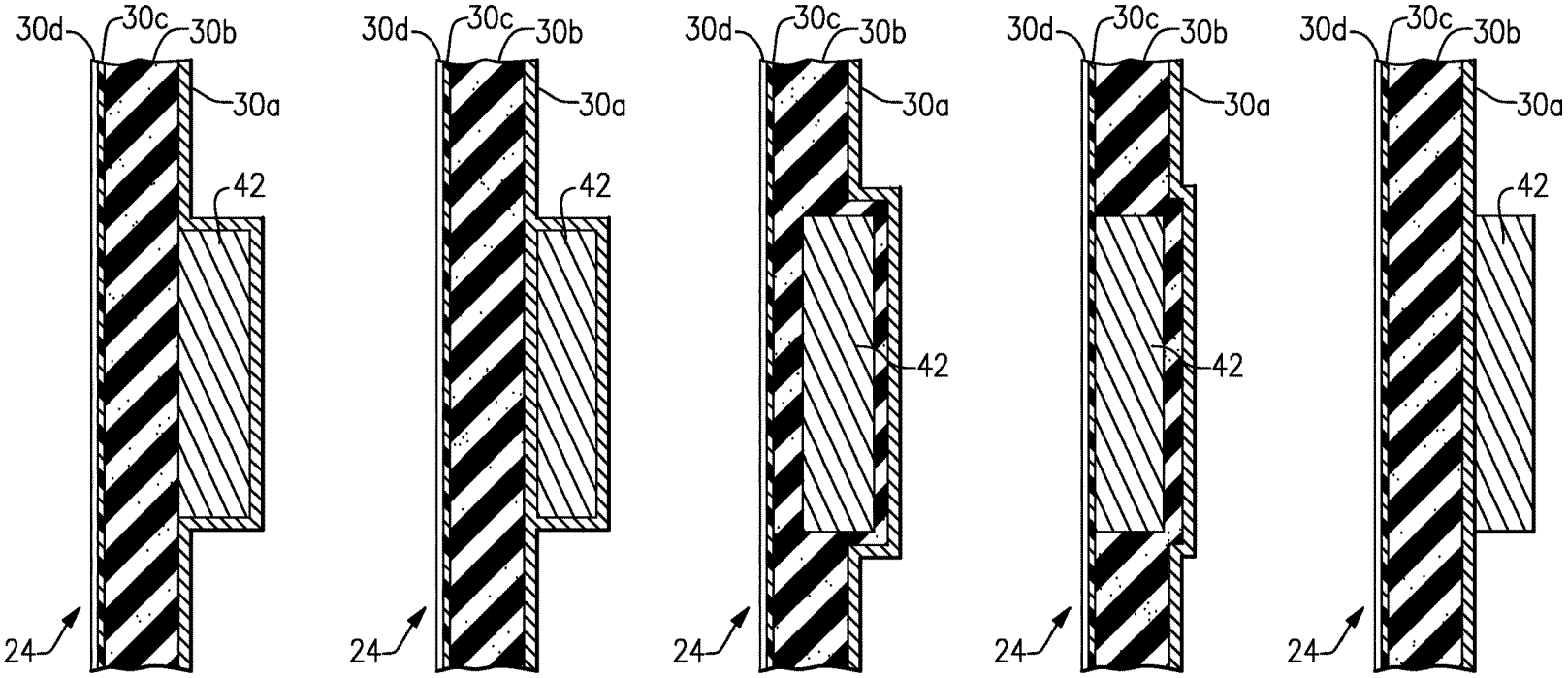
FIG. 3 shows an example multi-layer wall structure of a bathing vessel having a wood-containing composite panel between polyurethane layers.
FIG. 4 shows an example multi-layer wall structure of a bathing vessel having a wood-containing composite panel encapsulated within a back polyurethane layer.
FIG. 5 shows an example multi-layer wall structure having a wood-containing composite panel encapsulated within an intermediate polyurethane layer.
FIG. 6 illustrates an example multi-layer wall structure having a wood-containing composite panel between a layer of ABS material and a layer of polyurethane material.
FIG. 7 illustrates an example multi-layer wall structure having a wood-containing composite panel affixed to a back polyurethane layer.

Referring to FIGS. 3-7, the wood-containing composite panel 42 may be incorporated into the multi-layer structure of the wall 24 in a variety of different ways. In FIG. 3, the wood-containing composite panel 42 is encapsulated on all sides within the multi-layer structure of the wall 24. In this case, the wood-containing composite panel 42 is between the first layer of polyurethane material 30*a* and the second layer of polyurethane material 30*b* and is chemically bonded to those layers.

In a method of manufacturing the bathing vessel 20, the second layer of polyurethane material 30*b* is applied to the layer of ABS material 30*c*. For instance, the polyurethane material is a two-part mixture that is applied in an uncured state to the layer of ABS material 30*c*. Prior to full curing of the polyurethane material, the wood-containing composite panel 42 is pressed into the polyurethane material and held until the material substantially cures. Upon curing of the polyurethane material, the polyurethane material and the resin material of the wood-containing composite panel 42 chemically bond to hold the wood-containing composite panel 42 in place.

Another layer of uncured polyurethane material is then applied to form the first layer of polyurethane material 30*a*. In this case, the uncured polyurethane material is applied onto the second layer of polyurethane material 30*b* and the wood-containing composite panel 42 such that the wood-containing composite panel 42 is encapsulated between the two layers 30*a* and 30*b*. Upon curing, the polyurethane material of the first layer of polyurethane material 30*a* chemically bonds to the resin material of the wood-containing composite panel 42.

The chemical bonding between the resin material of the wood-containing composite panel 42 and the polyurethane materials of the layers 30*a* and 30*b* forms a strong composite in the area in which the fixture 40 is to be attached. The strength of the composite in that area facilitates the reduction of deflection upon application of a load to the fixture, such as to meet strength and deflection requirements.

In FIG. 4, the wood-containing composite panel 42 is encapsulated on all sides within the first layer of polyurethane material 30*a*. In this case, the polyurethane material of layer 30*b* is applied onto the layer of ABS material 30*c* and allowed to fully cure. Upon curing, polyurethane material for the layer 30*a* is applied onto the layer 30*b*. Prior to curing, the wood-containing composite panel 42 is pressed into the uncured polyurethane material. The polyurethane material is allowed to at least partially cure to hold the wood-containing composite panel 42 in place.

Once affixed, additional uncured polyurethane material is applied over the wood-containing composite panel 42 and subsequently allowed to cure such that the wood-containing composite panel 42 is encapsulated on all sides within the layer 30*a*. The chemical bonding between the resin material of the wood-containing composite panel 42 and the polyurethane material forms a strong composite structure of the wall 24 to meet desired strength and deflection requirements.

In FIG. 5, the wood-containing composite panel 42 is encapsulated on all sides within the layer 30*b*. An initial layer of uncured polyurethane material is applied to the layer of ABS material 30*c*. The wood-containing composite panel 42 is then pressed into the uncured polyurethane material until the material cures and is able to hold the wood-containing composite panel 42 in place.

Another layer of uncured polyurethane material is then applied over the initial layer and the wood-containing composite panel 42, such that the wood-containing composite panel 42 is embedded within the layer 30*b*. The polyurethane material is then allowed to cure, and the polyurethane material of the layer 30*a* is applied and cured. Similar to the prior examples, the resin material of the wood-containing composite panel 42 chemically bonds to the polyurethane material of the layer 30*b* to form a strong composite to meet strength and deflection requirements.

In FIG. 6, the wood-containing composite panel 42 is arranged between the layer of ABS material 30*c* and the layer 30*b*. In the manufacturing process of the bathing vessel 20, the wood-containing composite panel 42 is placed next to the layer of ABS material 30*c*. Optionally, the wood-containing composite panel 42 may be held in place against the layer of ABS material 30*c* using an adhesive material, gravity, or other suitable technique.

Uncured polyurethane material is then applied over the top of the wood-containing composite panel 42 and subsequently allowed to cure to hold the wood-containing composite panel 42 in place and form a chemical bond therewith. Similar to the prior examples, the chemical bonding between the resin material of the wood-containing composite panel 42 and the polyurethane material forms a strong composite to meet strength and deflection requirements.

In FIG. 7, the wood-containing composite panel 42 is fixed to the back side of the layer 30*a*. In the manufacturing process of the bathing vessel 20, uncured polyurethane material may be applied to the layer 30*b* to form the layer 30*a*. Prior to full curing of the polyurethane material, the wood-containing composite panel 42 may be pressed into the uncured polyurethane material. Upon curing, the polyurethane material forms a chemical bond with the resin material of the wood-containing composite panel 42.

Alternatively, the uncured polyurethane material can be allowed to fully cure prior to the application of the wood-containing composite panel 42. Upon curing, the wood-containing composite panel 42 may then be affixed to the layer 30*a* using additional uncured polyurethane material as an adhesive there between. The polyurethane material again forms a strong chemical bond with the resin material of the wood-containing composite panel 42.

Figure 8:
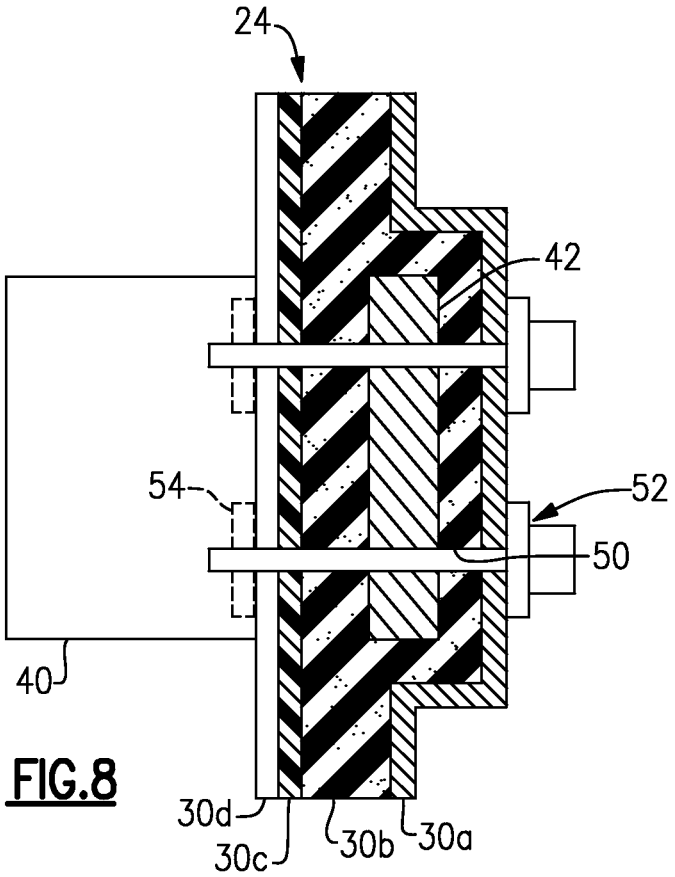
FIG. 8 illustrates an example multi-layer wall structure of a bathing vessel having a wood-containing composite panel encapsulated therein to affix a fixture to the wall.

FIG. 8 illustrates an example based upon the arrangement of the wood-containing composite panel 42 as shown in FIG. 5. However, it is to be understood that the example may also apply to other structures, such as those in the examples of FIGS. 3, 4, 6 and 7. In this example, at least one opening 50 extends through the layers 30*a-d* for affixing the fixture 40 to the wall 24. A fastener 52, such as bolt, extends through the opening 50 to attach a bracket 54 to the wall 24. The fixture 40 is then attached to the bracket 54 in a known manner. The number of openings 50 and fasteners 52 may depend upon the type of fixture 40 and strength and deflection requirements, for example.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A bathing vessel comprising:

a base and at least one wall extending vertically from the base, the wall comprising a multi-layer structure that includes a layer of acrylic material on a first layer of polyurethane material, a layer of acrylonitrile butadiene styrene (ABS) material between the layer of acrylic material and the first layer of polyurethane material, and a second layer of polyurethane material between the layer of ABS material and the first layer of polyurethane material; and a wood-containing composite panel chemically bonded to at least one of the first layer of polyurethane material or the second layer of polyurethane material, wherein the wood-containing composite panel is encapsulated on all sides within the multi-layer structure.

2. The bathing vessel as recited in claim 1, wherein the wood-containing composite panel is interposed between the first layer of polyurethane material and the second layer of polyurethane material.

3. The bathing vessel as recited in claim 1, wherein the wood-containing composite panel is chemically bonded to the first layer of polyurethane material on a side of the first layer of polyurethane material that is opposite from the second layer of polyurethane material.

4. The bathing vessel as recited in claim 1, wherein the wood-containing composite panel is a composite of wood particles and a polymeric resin.

5. The bathing vessel as recited in claim 1, wherein the wood-containing composite panel includes phenol formaldehyde.

6. The bathing vessel as recited in claim 1, wherein the wood-containing composite panel includes methyl diphenyl diisocyanate.

7. The bathing vessel as recited in claim 1, further comprising at least one opening extending through the wall and the wood-containing composite panel.

8. The bathing vessel as recited in claim 7, further comprising a fixture attached to the wall via the at least one opening.

9. A bathing vessel comprising:

a wall comprising a multi-layer structure of a layer of acrylic material arranged on a first layer of polyurethane material, a layer of acrylonitrile butadiene styrene (ABS) material between the layer of acrylic material and the first layer of polyurethane material, and a second layer of polyurethane material between the layer of ABS material and the first layer of polyurethane material;

a wood-containing composite panel chemically bonded to at least one of the first layer of polyurethane material and the second layer of polyurethane material, wherein the wood-containing composite panel is encapsulated on all sides within the multi-layer structure;

at least one opening extending through the wall and the wood-containing composite panel; and a fixture attached to the wall via the at least one opening.

* * * * *